US007490582B2

(12) United States Patent
Hirai et al.

(10) Patent No.: US 7,490,582 B2
(45) **Date of Patent: *Feb. 17, 2009**

(54) COMBUSTION TYPE POWER TOOL HAVING FIN FOR EFFECTIVELY COOLING CYLINDER

(75) Inventors: Shoichi Hirai, Hitachinaka (JP); Yoshitaka Akiba, Hitachinaka (JP); Tomomasa Nishikawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/448,757

(22) Filed: Jun. 8, 2006

(65) Prior Publication Data

US 2006/0225676 A1 Oct. 12, 2006

Related U.S. Application Data

(63) Continuation of application No. 11/122,013, filed on May 5, 2005, now Pat. No. 7,063,053.

(30) Foreign Application Priority Data

May 10, 2004 (JP) ..... P2004-140267

(51) Int. Cl.
*F02B 71/00* (2006.01)
*B25C 1/04* (2006.01)

(52) U.S. Cl. ..... 123/46 SC; 227/10

(58) Field of Classification Search ..... 123/46 R–46 H; 227/8, 10, 130
See application file for complete search history.

(56) References Cited

U.S. PATENT DOCUMENTS

| | | | | |
|---|---|---|---|---|
| 2,480,879 | A | 9/1949 | Rice, Jr. | |
| 4,403,722 | A | 9/1983 | Nikolich | |
| 5,197,646 | A | 3/1993 | Nikolich | |
| 5,558,264 | A * | 9/1996 | Weinstein | 227/10 |

FOREIGN PATENT DOCUMENTS

| | | |
|---|---|---|
| EP | 1 236 544 | 9/2002 |
| EP | 1 559 514 | 8/2005 |

* cited by examiner

*Primary Examiner*—Noah Kamen
(74) *Attorney, Agent, or Firm*—Antonelli, Terry, Stout & Kraus, LLP.

(57) ABSTRACT

A combustion-type power tool includes a housing having one end, a head portion disposed at the one end, and a cylinder disposed in the housing, the cylinder being formed with an exhaust hole. A piston is reciprocally movable in the cylinder, and a combustion-chamber frame is disposed in the housing and movable in an axial direction of the cylinder, the combustion-chamber frame being abuttable on the head portion to provide a combustion chamber in cooperation with the head portion and the piston. A fin is disposed on the cylinder and has a portion extending in a direction slanted in relation to the axial direction and oriented toward the exhaust hole.

10 Claims, 3 Drawing Sheets

COMBUSTION TYPE POWER TOOL HAVING FIN FOR EFFECTIVELY COOLING CYLINDER

CROSS REFERENCE TO RELATED APPLICATION

This application is a continuation application of U.S. application Ser. No. 11/122,013, filed May 5, 2005, now U.S. Pat. No. 7,063,053, the contents of which are incorporated herein by reference.

BACKGROUND OF THE INVENTION

1. Field of the Invention

The present invention relates to a combustion-type power tool, and more particularly, to a combustion-type fastener driving tool in which liquidized gas is ejected from a gas canister into a combustion chamber, mixed with air and ignited to drive a piston, thus generating power to drive nails or the like.

2. Description of Related Art

A conventional combustion-type power tool generally includes a housing, a handle, a trigger switch, a head cap, a combustion-chamber frame, a push lever, a cylinder, a piston, a driver blade, a motor, a fan, a gas canister, an ignition plug, an exhaust-gas check valve, an exhaust cover, a magazine, and a tail cover. The head cap is disposed at one end of the housing and is formed with a combustible gas passage. The handle is fixed to the housing and is provided with the trigger switch. The combustion-chamber frame is movable in the housing in the lengthwise direction thereof. The combustion-chamber frame is urged in a direction away from the head cap by a spring, and one end of the combustion-chamber frame is abuttble on the head cap against the biasing force of the spring.

The push lever is movably provided at the other end of the housing and is coupled to the combustion-chamber frame. The cylinder is secured to the housing and in communication with the combustion-chamber frame. The cylinder guides the movement of the combustion-chamber frame and is formed with an exhaust port. The piston is reciprocally movable in the cylinder. While the combustion-chamber frame has its one end abutting on the head cap, the piston defines a combustion chamber in cooperation with the head cap, the combustion-chamber frame and the end portion of the cylinder, the end portion being positioned near the head cap. The driver blade extends from the end of the piston which faces away from the combustion chamber toward the other end of the housing.

The motor is supported on the head cap. The fan is fastened to the motor and provided in the combustion chamber. The fan mixes the combustible gas with air in the combustion chamber for promoting combustion. The fan also serves to introduce an external air into the housing when the combustion-chamber frame is moved away from the head cap for scavenging within the combustion-chamber frame, and at the same time serves to cool an outer peripheral wall of the cylinder. The gas canister is assembleable in the housing and contains liquidized combustible gas that is to be ejected into the combustion chamber through a combustible gas passage formed in the head cap. The ignition plug is faced to the combustion chamber to ignite a mixture of combustible gas and air. The exhaust-gas check valve selectively closes the exhaust port. The exhaust cover covers the exhaust gas check valve for directing the exhaust gas in the axial direction of the tool.

The magazine is positioned at the other end of the housing and contains fastening elements such as nails. The tail cover is interposed between the magazine and the push lever to supply the fastener from the magazine to a position of a moving locus of the driver bit.

In order to provide a hermetic state of the combustion chamber when the combustion chamber frame is brought into abutment with the head cap, a seal member (seal ring) is provided at a predetermined position of the head cap for intimate contact with an upper portion of the combustion-chamber frame and another seal member (seal ring) is provided at the cylinder near the head cap for intimate contact with a lower portion of the combustion chamber frame.

Upon ON operation of the trigger switch while the push lever is pushed against a workpiece, combustible gas is ejected into the combustion chamber from the gas canister assembled in the housing. In the combustion chamber, the combustible gas and air are stirred and mixed together by the fan. The ignition plug ignites the resultant mixture gas. The mixture gas explodes to drive piston for driving the driver blade, which in turn drives nails into a workpiece such as a wood block. After explosion, the combustion chamber frame is maintained in its abutting position to the head cap while the trigger switch is in the ON state. During this abutting period, the exhaust gas check valve is closed when the combustion gas is exhausted and a pressure in the combustion chamber becomes lower than an atmospheric pressure to maintain closing state of the combustion chamber. Further, thermal vacuum is generated in the combustion chamber due to pressure drop caused by decrease in temperature. Therefore, the piston can be moved toward its upper dead center because of the pressure difference between upper and lower spaces of the cylinder with respect to the piston. Such conventional power tool is described in for example U.S. Pat. Nos. 4,403,722 and 5,197,646. The combustion-type power tool does not need a compressor and a hose which are needed for a compressed-air type power tool, thereby achieving good operationality.

SUMMARY OF THE INVENTION

As driving operations continue, the cylinder of the combustion-type power tool accumulates heat which is generated by the combustion in the combustion chamber. Thus, the outer peripheral wall of the cylinder becomes very hot when the driving operations are performed continuously. Accordingly, it is generally known that fins are provided at the outer peripheral wall such that the outer peripheral wall can be cooled effectively during the scavenging after the driving operations. The outer peripheral wall can be cooled effectively because, during the scavenging, the air passes along the outer peripheral wall and draws heat from the fins. However, as shown in U.S. Pat. No. 5,197,646, for example, conventional fins extend straight or linearly in an axial direction of the cylinder and do not provide effective cooling.

In view of the above-described drawbacks, it is an objective of the present invention to provide a combustion-type power tool which can cool the cylinder effectively, thereby achieving a longer useful life of the power tool.

In order to attain the above and other objects, the present invention provides a combustion-type power tool. The combustion-type power tool includes a housing, a head portion, a cylinder, a piston, a combustion-chamber frame, and a fin. The housing has one end and another end and defines an axial direction. The head portion is disposed at the one end. The cylinder is disposed in and is fixed to the housing. The cylinder has a peripheral wall which defines a peripheral direction. The cylinder has one axial end and another axial end. The one axial end is closer to the one end than the another axial end is. The peripheral wall has an inner peripheral surface which defines an inner space and has an outer peripheral surface opposite to the inner peripheral surface. The peripheral wall is formed with an exhaust hole at a first axial position. The piston is reciprocally movable in the axial direction between a top dead center and a bottom dead center and is slidable in contact with the inner peripheral surface. The top dead center is closer to the one end than the bottom dead center is. The piston divides the inner space into an upper space and a lower space. The upper space is closer to the one end than the lower space is. The combustion-chamber frame is disposed in the housing and is movable in the axial direction. The combustion-chamber frame is abuttable on the head portion to provide a combustion chamber in cooperation with the head portion and the piston. The piston allows the combustion chamber to be in fluid communication with an atmosphere through the upper space and through the exhaust hole when the piston is located at the bottom dead center. The fin is disposed at the outer peripheral surface and has a portion extending in a direction slanted in relation to the axial direction and oriented toward the exhaust hole.

The present invention also provides a combustion-type power tool. The combustion-type power tool includes a housing, a head portion, a cylinder, a piston, a combustion-chamber frame, and a fin. The housing has one end and another end and defines an axial direction. The head portion is disposed at the one end. The cylinder is disposed in and is fixed to the housing. The cylinder has a peripheral wall which defines a peripheral direction. The cylinder has one axial end and another axial end. The one axial end is closer to the one end than the another axial end is. The peripheral wall has an inner peripheral surface which defines an inner space and has an outer peripheral surface opposite to the inner peripheral surface. The peripheral wall is formed with an exhaust hole at a first axial position. The piston is reciprocally movable in the axial direction between a top dead center and a bottom dead center and is slidable in contact with the inner peripheral surface. The top dead center is closer to the one end than the bottom dead center is. The piston divides the inner space into an upper space and a lower space. The upper space is closer to the one end than the lower space is. The combustion-chamber frame is disposed in the housing and is movable in the axial direction. The combustion-chamber frame is abuttable on the head portion to provide a combustion chamber in cooperation with the head portion and the piston. The piston allows the combustion chamber to be in fluid communication with an atmosphere through the upper space and through the exhaust hole when the piston is located at the bottom dead center. The fin is disposed at the outer peripheral surface and includes a first row of fins and a second row of fins. The first row of fins is arranged in the peripheral direction and is located at a second axial position. The second row of fins is arranged in the peripheral direction and is located at a third axial position. The second axial position is closer to the one axial end than the third axial position is. The first row of fins and the second row of fins are arranged alternately in the peripheral direction.

DETAILED DESCRIPTION OF THE PREFERRED EMBODIMENTS

Figure 1:
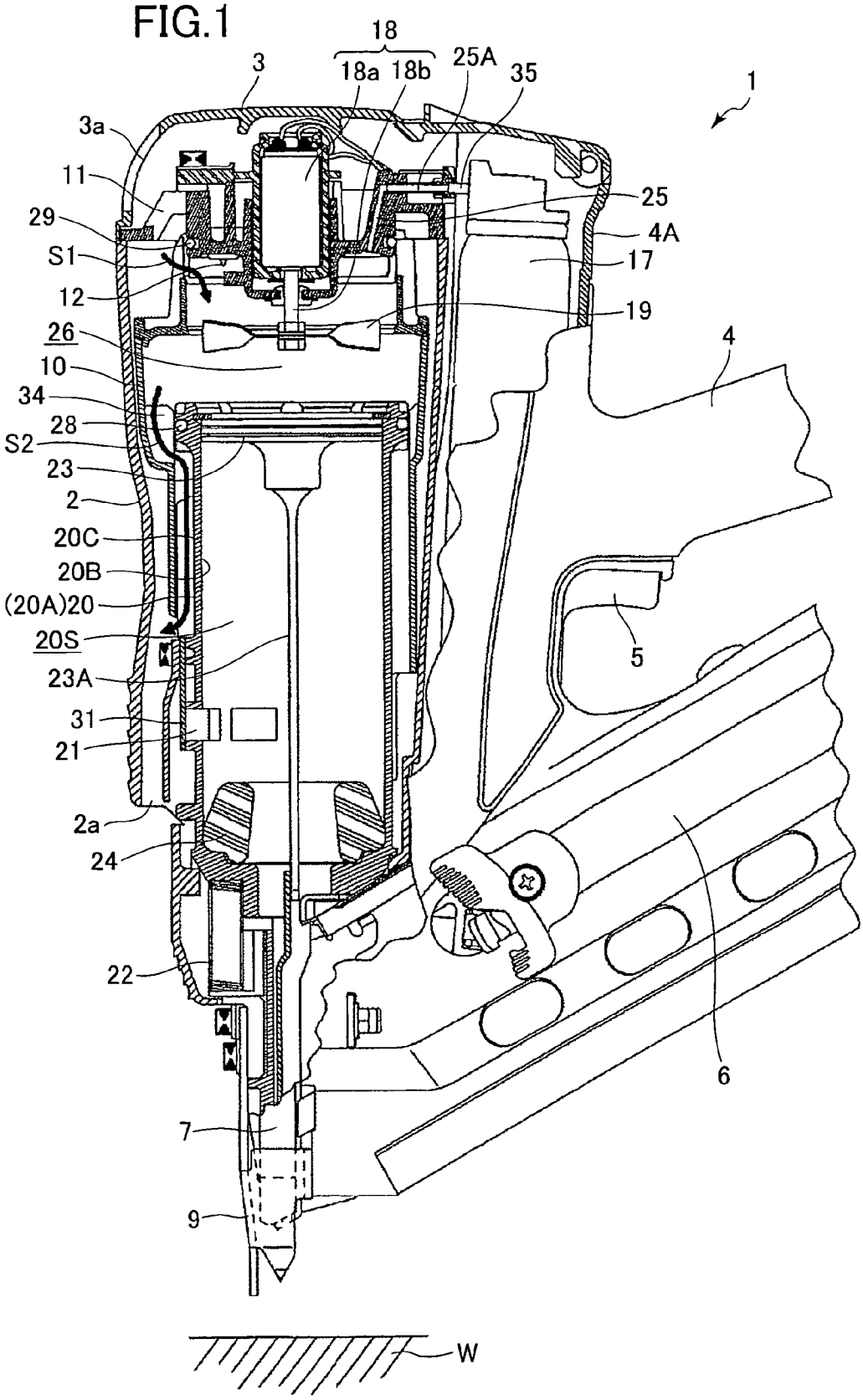
FIG. 1 is a side view with a part in cross section showing essential parts of a combustion-type nail driver embodying a combustion-type power tool according to an embodiment of the present invention, in which the combustion-type nail driver is in an initial state.

A combustion-type power tool according to an embodiment of the present invention will be described with reference to FIGS. 1 through 3. The embodiment pertains to a combustion-type nail gun. The combustion-type nail gun 1 has a housing 2 constituting an outer frame. A head cover 3 formed with an intake port 3*a* is mounted on the top of the housing 2. A handle 4 is attached to the housing 2 and extends from a side of the housing 2. The handle 4 has a trigger switch 5. A canister housing 4A is provided in the handle 4 at a position immediately beside the housing 2. A gas canister 17 containing therein a combustible liquefied gas is detachably disposed in the canister housing 4A. A magazine 6 is provided at a lower side of the handle 4. The magazine 6 contains nails (not shown). The housing 2 has a lower portion formed with an exhaust port 2*a* for discharging a combustion gas to the atmosphere.

A nose 7 extends from a lower end of the housing 2. The nose 7 is formed integrally with a cylinder 20 (described later) and has a tip end in confrontation with a workpiece W. The nose 7 is adapted for guiding sliding movement of a drive blade 23A (described later) and for setting the nail to a predetermined position. A push lever 9 is movably provided and has a lower portion slidable with respect to the lower end portion of the nose 7. The push lever 9 is coupled to an arm member (not shown) that is engaged with a combustion-chamber frame 10 which will be described later through a pin (not shown). A compression coil spring 22 is interposed between the arm member and the cylinder 20 for normally urging the push lever 9 in a protruding direction from the housing 2. When the housing 2 is pressed toward the workpiece W while the push lever 9 is in abutment with the workpiece W against a biasing force of the compression coil spring 22, an upper portion of the push lever 9 is retractable into the housing 2.

A head cap 11 is secured to the top of the housing 2 for closing the open top end of the housing 2. The head cap 11 supports a motor 18 at a position opposite to a combustion chamber 26 described later. Further, an ignition plug 12 is also supported to the head cap 11 at a position adjacent to the motor 18. The ignition plug 12 has an ignition spot exposed to the combustion chamber 26. The ignition plug 12 is ignitable upon manipulation to the trigger switch 5. An injection rod 35 is provided at the gas canister 17. The motor 18 has a motor case 18*a* and an output shaft 18*b*, and is supported at the head cap 11.

A head switch (not shown) is provided in the housing 2 for detecting an uppermost stroke end position of the combustion-chamber frame 10 when the combustion-type nail gun 1 is pressed against the workpiece W. Thus, the head switch can be turned ON when the push lever 9 is elevated to a predetermined position for starting rotation of the motor 18.

The head cap 11 has a handle side in which is formed a fuel ejection passage 25 which allows a combustible gas to pass therethrough. One end of the ejection passage 25 serves as an ejection port that opens at the lower surface of the head cap 11. Another end of the ejection passage 25 serves as a gas canister connecting portion 25A in communication with the injection rod 35. A seal member 29 such as an O-ring is provided at the head cap 11.

The combustion-chamber frame 10 is provided in the housing 2 and is movable in an axial (longitudinal) direction of the housing 2. The uppermost end of the combustion-chamber frame 10 is abuttable on the lower peripheral side of the head cap 11. Since the arm member connects the combustion-chamber frame 10 to the push lever 9, the combustion-chamber frame 10 is movable in interlocking relation to the push lever 9. The cylinder 20 is disposed in and fixed to the housing 2. The cylinder 20 has an upper axial end 20U and a lower axial end 20L. The cylinder 20 has a peripheral wall 20A which defines a peripheral direction. The peripheral wall 20A has an inner peripheral surface 20B which defines an inner space 20S and has an outer peripheral surface 20C opposite to the inner peripheral surface 20B. The inner circumference of the combustion-chamber frame 10 is in sliding contact with an outer peripheral surface of the cylinder 20. Thus, the sliding movement of the combustion-chamber frame 10 is guided by the cylinder 20. The cylinder 20 has an axially intermediate portion formed with exhaust holes 21. The exhaust holes 21 include four through-holes arranged in a peripheral direction of the cylinder 20. An upper row of fins 60, a middle row of fins 70, and a lower row of fins 80 are disposed on the outer peripheral surface 20C of the cylinder 20 as will be described later. An exhaust-gas check valve 31 is provided to selectively close the exhaust holes 21. A seal member 28 such as an O-ring is provided at an upper portion of the cylinder 20. Further, a bumper 24 is provided on the bottom of the cylinder 20.

As shown in FIG. 1, a piston 23 is slidably and reciprocally provided in the cylinder 20. That is, the piston 23 is reciprocally movable in the axial direction between its top dead center and bottom dead center. The piston 23 divides the inner space 20S of the cylinder 20 into an upper space above the piston 23 and a lower space below the piston 23. The driver blade 23A extends downwards from a lower side of the piston 23 to the nose 7. The driver blade 23A is positioned coaxially with the nail setting position in the nose 7, so that the driver blade 23A can strike against the nail during movement of the piston 23 toward its bottom dead center. The bumper 24 is made from a resilient material. When the piston 23 moves to its bottom dead center, the piston 23 abuts on the bumper 24 and stops. In this case, the bumper 24 absorbs a surplus energy of the piston 23.

When the upper end of the combustion-chamber frame 10 abuts on the head cap 11, the head cap 11, the combustion-chamber frame 10, and the upper cylinder space above the piston 23 define the combustion chamber 26. When the combustion-chamber frame 10 is separated from the head cap 11, a first flow passage S1 in communication with an atmosphere is provided between the head cap 11 and the upper end of the combustion-chamber frame 10, and a second flow passage S2 in communication with the first flow passage S1 is provided between the lower end portion of the combustion-chamber frame 10 and the upper end portion of the cylinder 20. The first and second flow passages S1 and S2 allow a combustion gas and a fresh air to pass along the outer peripheral surface 20C of the cylinder 20 for discharging these gas through the exhaust port 2*a* of the housing 2. Further, the above-described intake port 3*a* is formed for supplying a fresh air into the combustion chamber 26, and the exhaust holes 21 are adapted for discharging combustion gas generated in the combustion chamber 26.

The fan 19 is disposed in the combustion chamber 26. Rotation of the fan 19 performs the following three functions. First, the fan 19 stirs and mixes the air with the combustible gas as long as the combustion-chamber frame 10 remains in abutment with the head cap 11. Second, after the mixed gas has been ignited, the fan 19 causes turbulent combustion of the air-fuel mixture, thus promoting the combustion of the air-fuel mixture in the combustion chamber 26. Third, the fan 19 performs scavenging such that the exhaust gas in the combustion chamber 26 can be scavenged therefrom and also performs cooling to the combustion-chamber frame 10 and the cylinder 20 when the combustion-chamber frame 10 moves away from the head cap 11 and when the first and second flow passages S1 and S2 are provided.

A plurality of ribs 34 are provided on the inner peripheral portion of the combustion-chamber frame 10 which portion defines the combustion chamber 26. The ribs 34 extend in the axial direction of the combustion-chamber frame 10 and project radially inwardly toward the axis of the housing 2. The ribs 34 cooperate with the rotating fan 19 to promote stirring and mixing of air with the combustible gas in the combustion chamber 26.

The upper row of fins 60, the middle row of fins 70, and the lower row of fins 80 disposed at the cylinder 20 will be described in greater detail while referring to FIGS. 2 and 3.

The upper row of fins 60 is arranged in the peripheral direction of the cylinder 20. The upper row of fins 60 is located at an upper position than the exhaust holes 21. In other words, an axial position of the upper row of fins 60 is closer to the upper axial end 20U than an axial position of the exhaust holes 21 is. As shown in FIGS. 2 and 3, the upper row of fins 60 includes straight fins 61, bent fins 62 through 64, straight fins 65, and bent fins 66 and 67.

Figure 2:
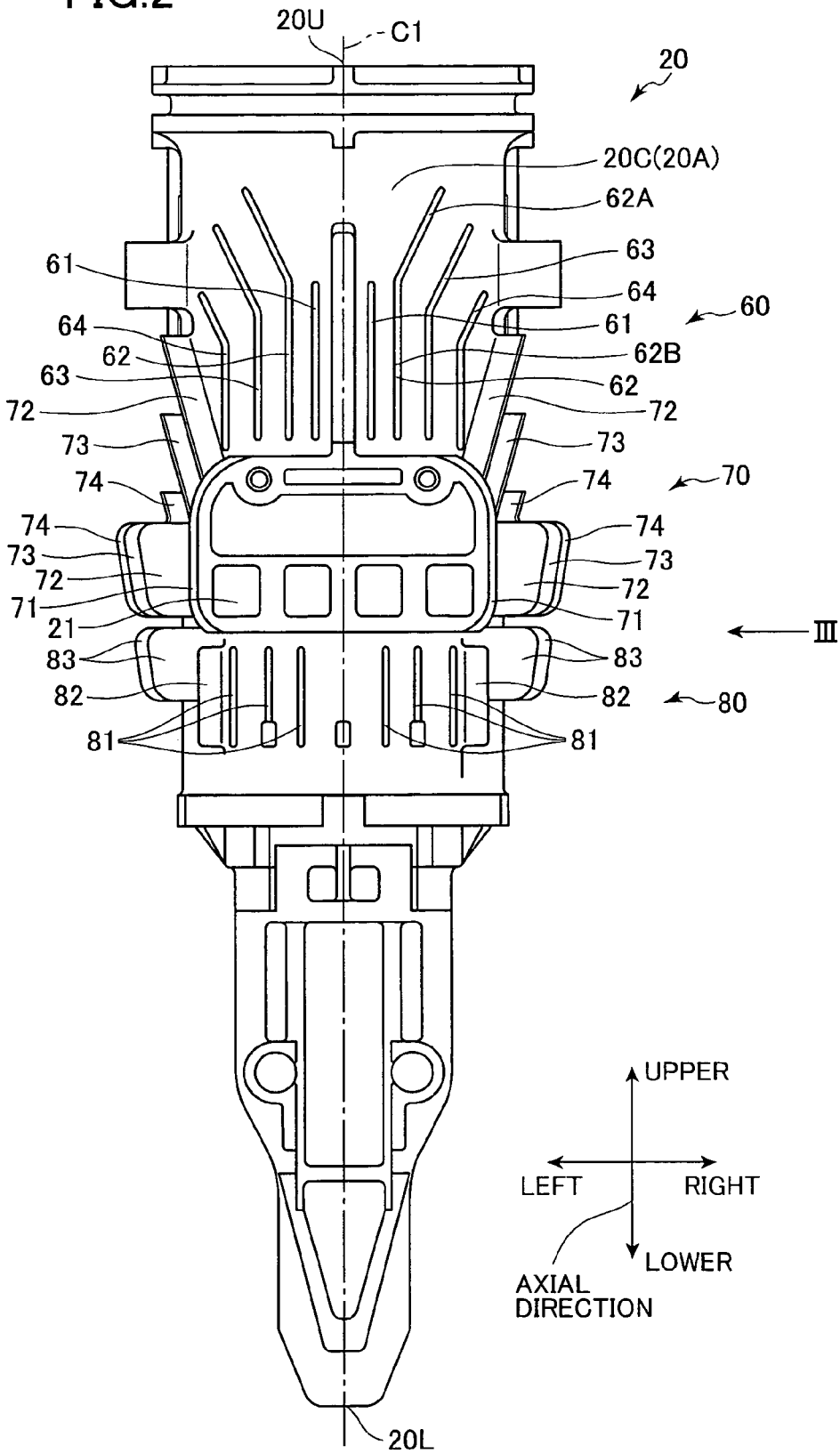
FIG. 2 is a front view showing fins provided at a cylinder of the combustion-type nail driver according to the embodiment of the present invention.

As shown in FIG. 2, the straight fins 61 and the bent fins 62 through 64 are disposed at the front of the cylinder 20. The straight fins 61 are disposed near a center line C1 which is the center in a left-right direction of the cylinder 20. The straight fins 61 extend straight or linearly in parallel with the axial direction.

The bent fins 62 through 64 are disposed at the left and right sides of the straight fins 61. Each bent fin 62 has an upper portion 62A and a lower portion 62B which are formed integrally. The lower portion 62B is located at a lower position than the upper portion 62A. That is, the upper portion 62A is closer to the upper axial end 20U than the lower portion 62B is. The lower portion 62B extends straight in the axial direction. The upper portion 62A extends in a direction slanted in relation to the axial direction and oriented toward the exhaust holes 21. Other bent fins 63 and 64 also have upper portions and lower portions, but the shapes of the bent fins 63 and 64 are slightly different from the shape of the bent fins 62. In other words, the lengths of the upper portions and the lower portions are different depending on each fin.

Figure 3:
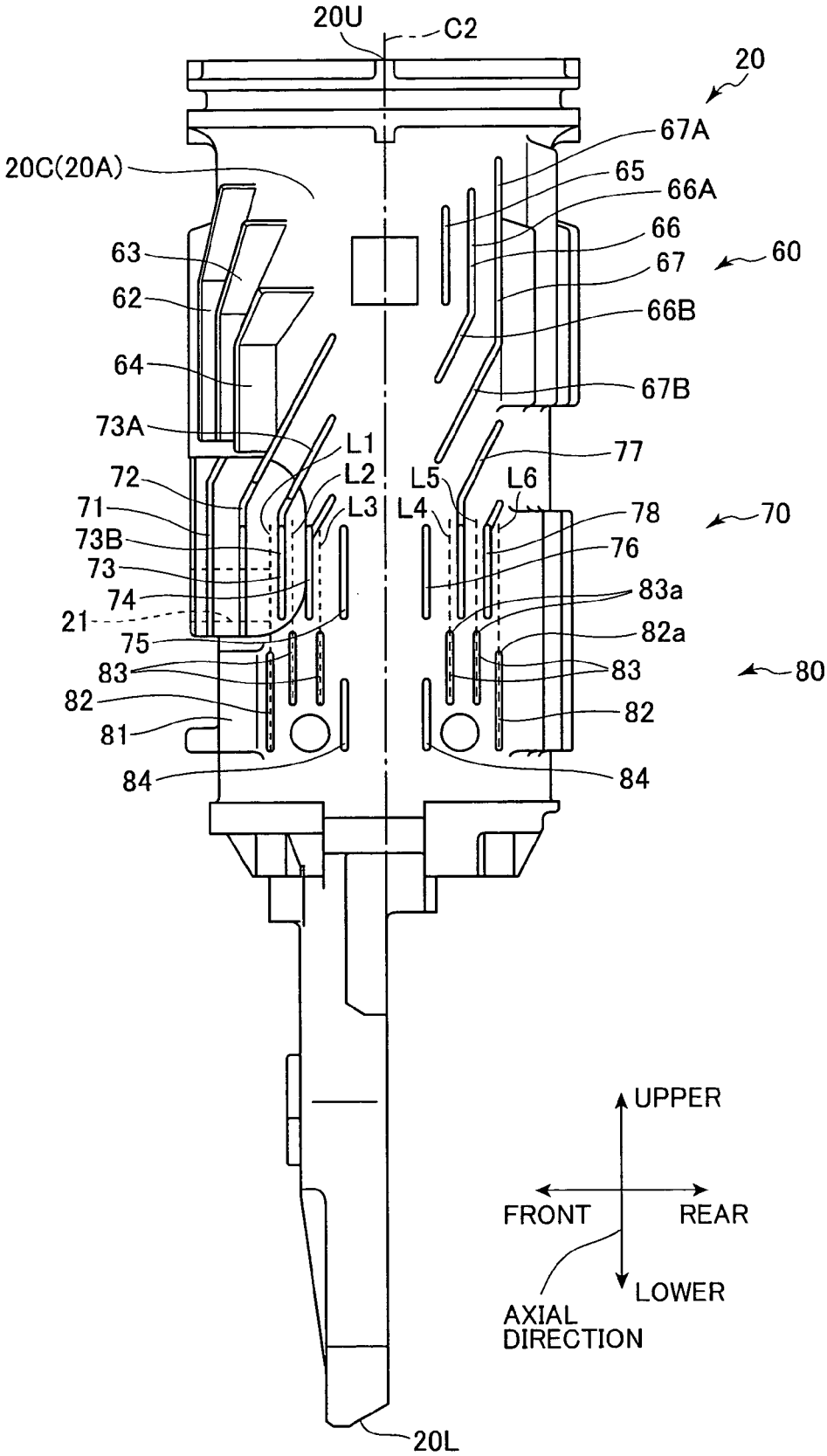
FIG. 3 is a right side view as viewed from an arrow III of FIG. 2.

As shown in FIG. 3, the straight fin 65, the bent fins 66 and 67 are disposed at the right side of the cylinder 20. Since the left side of the cylinder 20 has a symmetrical construction with the right side, only the right side of the cylinder 20 will be described. The straight fin 65 extends straight in parallel with the axial direction. The bent fins 66 and 67 are disposed at the rear of the straight fin 65. The bent fin 66 has an upper portion 66A and a lower portion 66B which are formed integrally. The lower portion 66B is located at a lower position than the upper portion 66A. The upper portion 66A extends straight in the axial direction. The lower portion 66B extends in a direction slanted in relation to the axial direction and oriented toward the exhaust holes 21. The other bent fin 67 also has an upper portion 67A and a lower portion 67B, but the upper portion 67A and the lower portion 67B are longer than the upper portion 66A and the lower portion 66B, respectively.

As shown in FIGS. 2 and 3, the middle row of fins 70 is arranged in the peripheral direction of the cylinder 20. The middle row of fins 70 is located at a lower position than the upper row of fins 60. The middle row of fins 70 include bent fins 71 through 74, straight fins 75 and 76, and bent fins 77 and 78. The middle row of fins 70 is disposed at the left and right sides of the cylinder 20 since the exhaust holes 21 are formed at the front of the cylinder 20.

As shown in FIG. 3, the straight fins 75 and 76 are located near a center line C2 which is the center in a front-rear direction of the cylinder 20. The straight fins 75 and 76 extend straight in parallel with the axial direction. The bent fin 73 has an upper portion 73A and a lower portion 73B. The upper portion 73A is located at an upper position than the exhaust holes 21. In other words, an axial position of the upper portion 73A is positioned between the axial position of the exhaust holes 21 and the axial position of the upper row of fins 60. The lower portion 73B is located at a substantially same axial position as the exhaust holes 21. In other words, an axial position of the lower portion 73B is coincident with the axial position of the exhaust holes 21. The upper portion 73A extends in a direction slanted in relation to the axial direction and oriented toward the exhaust holes 21. The other bent fins 71, 72, 74, 77 and 78 also have upper portions and lower portions, but their shapes are different from the shape of the bent fin 73. In other words, the lengths of the upper portions and the lower portions are different depending on each fin.

As shown in FIGS. 2 and 3, the lower row of fins 80 is arranged in the peripheral direction of the cylinder 20. The lower row of fins 80 is located at a lower position than the exhaust holes 21. In other words, an axial position of the lower row of fins 80 is closer to the lower axial end 20L than the axial position of the exhaust holes 21 is. The lower row of fins 80 includes straight fins 81 through 84 which extend straight in parallel with the axial direction.

As shown in FIG. 2, the straight fins 81 are disposed below the exhaust holes 21 at the front of the cylinder 20. As shown in FIG. 3, the straight fins 84 are located near the center line C2 on the right side of the cylinder 20. The straight fins 83 are located at the front and the rear of the straight fins 84. The straight fins 82 are located further at the front and the rear of the straight fins 83. The straight fins 82 are longer than the straight fins 83 and 84. The straight fins 82 and 83 have upstream (upper) end portions 82*a* and 83*a*, respectively. The upstream end portions 82*a* and 83*a* are end portions of the straight fins 82 and 83 at an upstream side of air flow which is generated during scavenging. The upstream end portions 82*a* and 83*a* greatly contribute to cooling of the cylinder 20 as will be described later.

As shown by lines L1 through L6 in FIG. 3, the straight fins 82 and 83 of the lower row of fins 80 are located between the fins 72 through 78 of the middle row of fins 70 in the peripheral direction. That is, the straight fins 82 and 83 are not aligned with the fins 72 through 78 in the axial direction. In other words, the straight fins 82 and 83 and the fins 72 through 78 are located alternately in the peripheral direction or in a staggered arrangement along the peripheral direction.

Operation of the combustion-type nail gun 1 will next be described. In the non-operational state of the combustion-type nail gun 1, the push lever 9 is biased downward in FIG. 1 by the biasing force of the compression coil spring 22, so that the push lever 9 protrudes from the lower end of the nose 7. Thus, the uppermost end of the combustion-chamber frame 10 is spaced away from the head cap 1 because the arm member connects the combustion-chamber frame 10 to the push lever 9. Further, a part of the combustion-chamber frame 10 which part defines the combustion chamber 26 is also spaced from the top portion of the cylinder 20. Hence, the first and second flow passages S1 and S2 are provided. In this condition, the piston 23 stays at its top dead center in the cylinder 20.

With this state, if the push lever 9 is pushed onto the workpiece W while holding the handle 4 by a user, the push lever 9 is moved upward against the biasing force of the compression coil spring 22. At the same time, the combustion-chamber frame 10 which is coupled to the push lever 9, is also moved upward in FIG. 1, closing the above-described first and second flow passages S1 and S2. Thus, the sealed combustion chamber 26 is provided.

In accordance with the movement of the push lever 9, the gas canister 17 is tilted toward the head cap 11 by an action of a cam (not shown). Thus, the injection rod 35 is pressed against the connecting portion 25A of the head cap 11. Therefore, the liquidized gas in the gas canister 17 is ejected once into the combustion chamber 26 through the ejection port of the ejection passage 25.

Further, in accordance with the movement of the push lever 9, the combustion-chamber frame 10 reaches its uppermost stroke end whereupon the head switch is turned ON to energize the motor 18 for starting rotation of the fan 19. Rotation of the fan 19 stirs and mixes the combustible gas with air in the combustion chamber 26.

In this state, when the trigger switch 5 provided at the handle 4 is turned ON, spark is generated at the ignition plug 12 to ignite the combustible gas. The combusted and expanded gas pushes the piston 23 to its bottom dead center. Therefore, a nail in the nose 7 is driven into the workpiece W by the driver blade 23A until the piston 23 abuts on the bumper 24.

After the nail driving, the piston 23 strikes against the bumper 24 and, at this time, the piston 23 is located at its bottom dead center. In this state, the combustion chamber 26 is in fluid communication with an atmosphere through the inner space 20S above the piston 23 and through the exhaust holes 21. Thus, the combustion gas is discharged out of the cylinder 20 through the exhaust holes 21 and through the check valve 31 provided at the exhaust holes 21. When the inner space 20S above the piston 23 and the combustion chamber 26 becomes the atmospheric pressure, the check valve 31 is closed.

Combustion gas still remaining in the cylinder 20 and the combustion chamber 26 has a high temperature at a phase immediately after the combustion. However, the high temperature can be absorbed into the walls of the cylinder 20, the ribs 34, and the combustion-chamber frame 10 to rapidly cool the combustion gas.

Thus, the pressure in the sealed space in the cylinder 20 above the piston 23 further drops to less than the atmospheric pressure (creating a so-called "thermal vacuum"). Accordingly, the piston 23 is moved back to the initial top dead center position.

Then, the trigger switch 5 is turned OFF, and the user lifts the combustion-type nail gun 1 from the workpiece W for separating the push lever 9 from the workpiece W. As a result, the push lever 9 and the combustion-chamber frame 10 move downward due to the biasing force of the compression coil spring 22 to restore a state shown in FIG. 1. In this case, the fan 19 keeps rotating for a predetermined period of time in spite of OFF state of the trigger switch 5 because of an operation of a control portion (not shown). In the state shown in FIG. 1, the first and second flow passages S1 and S2 are provided again at the upper and lower sides of the combustion chamber 26, so that fresh air flows into the combustion chamber 26 through the intake port 3*a* and through the first and second flow passages S1 and S2, expelling the residual combustion gas through the exhaust port 2*a*. Thus, the combustion chamber 26 is scavenged. Then, the rotation of the fan 19 is stopped to restore an initial stationary state. Thereafter, subsequent nail driving operation can be performed by repeating the above described operation process.

During the above-described scavenging, the air passes along the outer peripheral surface 20C and passes between the upper row of fins 60, the middle row of fins 70, and the lower row of fins 80. At this time, the air mainly flows toward the exhaust holes 21 because the upper row of fins 60 and the middle row of fins 70 control the air to flow toward the exhaust holes 21. Since a temperature becomes the highest around the exhaust holes 21 of the cylinder 20, the cylinder 20 can be effectively cooled and overheating of the cylinder 20 can be avoided. Thus, the combustion-type nail gun 1 can perform nail driving operations continuously, and workability can be improved.

In addition, since the straight fins 82 and 83 of the lower row of fins 80 and the fins 72 through 78 of the middle row of fins 70 are located alternately in the peripheral direction as described above, the cylinder 20 can be cooled even more effectively due to the following reason. It is generally known that cooling performance of a fin improves as its surface area exposed to air (radiation area) becomes larger. Thus, cooling performance could be improved by increasing the size of the fin or by increasing the number of fins. However, because the cylinder has certain length and diameter, the size of the fin and the number of the fins cannot be increased indefinitely. In addition, if the cylinder has too many fins, air resistance becomes larger which adversely affects the cooling performance. This is because too many fins hinder smooth air flow and lower efficiency of the scavenging.

Generally, an upstream end portion of a fin contributes most to cooling because air hits the upstream end portion first. In the above-described embodiment, because the fins 72 through 78 and the fins 82 and 83 are disposed alternately in the peripheral direction, the air which has passed between the fins 72 through 78 hits the upstream end portions 82*a* and 83*a* of the fins 82 and 83. Hence the cooling performance of the straight fins 82 and 83 improves. In other words, the cooling performance can be improved without increasing the air resistance even though the cylinder size is restricted. Accordingly, the cylinder 20 can be cooled even more effectively.

While the invention has been described in detail and with reference to specific embodiments thereof, it would be apparent to those skilled in the art that various changes and modification may be made therein without departing from the scope of the invention. For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston.

What is claimed is:

1. The combustion-type power tool comprising:

a housing;

a cylinder disposed in the housing and having a peripheral wall, wherein at least one exhaust hole is formed in the peripheral wall;

a piston slidably disposed in the cylinder;

a combustion-chamber frame disposed in the housing and movable in an axial direction; and a first group of fins disposed on an upper portion of the peripheral wall, said first group of fins including at least one straight fin extending in the axial direction and at least one bent fin having a first portion extending in parallel with the at least one straight fin of the first group of fins and a second portion extending in a direction slanted in relation to the axial direction and oriented toward the at least one exhaust hole;

wherein the first group of fins includes a plurality of bent fins having first portions with different lengths from each other.

2. The combustion-type power tool comprising:

a housing;

a cylinder disposed in the housing and having a peripheral wall, wherein at least one exhaust hole is formed in the peripheral wall;

a piston slidably disposed in the cylinder;

a combustion-chamber frame disposed in the housing and movable in an axial direction; and a first group of fins disposed on an upper portion of the peripheral wall, said first group of fins including at least one straight fin extending in the axial direction and at least one bent fin having a first portion extending in parallel with the at least one straight fin of the first group of fins and a second portion extending in a direction slanted in relation to the axial direction and oriented toward the at least one exhaust hole;

wherein the first group of fins includes a plurality of bent fins having second portions with different lengths from each other.

3. The combustion-type power tool comprising:

a housing;

a cylinder disposed in the housing and having a peripheral wall, wherein at least one exhaust hole is formed in the peripheral wall;

a piston slidably disposed in the cylinder;

a combustion-chamber frame disposed in the housing and movable in an axial direction;

a first group of fins disposed on an upper portion of the peripheral wall, said first group of fins including at least one straight fin extending in the axial direction and at least one bent fin having a first portion extending in parallel with the at least one straight fin of the first group of fins and a second portion extending in a direction slanted in relation to the axial direction and oriented toward the at least one exhaust hole; and a second group of fins disposed on a middle portion of the peripheral wall, said second group of fins including at least one straight fin extending in the axial direction and at least one bent fin having a first portion extending in a parallel with the at least one straight fin of the second group of fins and a second portion extending in a direction slanted in relation to the axial direction and oriented toward the at least one exhaust hole.

4. The combustion-type power tool as defined in claim 3, wherein the first portion of the bent fin of the second group of fins is located at a substantially same position as the exhaust hole in the axial direction.

5. The combustion-type power tool as defined in claim 3, wherein the second group of fins includes a plurality of bent fins having second portions with different lengths from each other.

6. The combustion-type power tool as defined in claim 3, further comprising a third group of fins disposed on a lower portion of the peripheral wall, the third group of fins including a plurality of straight fins extending in the axial direction.

7. The combustion-type power tool as defined in claim 3, wherein the third group of fins and first portions of the bent fins of the second group of fins are located alternately in a peripheral direction of the cylinder.

8. A combustion-type power tool comprising:

a housing;

a cylinder disposed in the housing and having a peripheral wall, wherein at least one exhaust hole is formed in the peripheral wall;

a piston slidably disposed in the cylinder;

a combustion-chamber frame disposed in the housing and movable in an axial direction;

a first group of fins disposed on a upper portion of the peripheral wall;

a second group of fins disposed on a middle portion of the peripheral wall; and a third group of fins disposed on a lower portion of the peripheral wall;

wherein the first and the second group of fins comprise straight fins extending in the axial direction and bent fins having portions extending in a direction slanted in relation to the axial direction and oriented toward the at least one exhaust hole.

9. The combustion-type power tool as defined in claim 8, wherein the third group of fins extend in the axial direction.

10. The combustion-type power tool as defined in claim 9, wherein the second group of fins comprise straight fins having portions extending in the axial direction which are located alternately with the third group of fins in a peripheral direction of the cylinder.

* * * * *